US012747604B2

(12) United States Patent
van der Meijden et al.

(10) Patent No.: US 12,747,604 B2
(45) Date of Patent: Sep. 29, 2026

(54) AUTOMATIC SWIMMING POOL CLEANERS ESPECIALLY ADEPT AT CLIMBING AND CLEANING POOL STAIRS

(71) Applicant: ZODIAC POOL SYSTEMS LLC, Carlsbad, CA (US)

(72) Inventors: Hendrikus Johannes van der Meijden, Midrand (ZA); Abian van der Meijden, Midrand (ZA); Dustin Borg, Poway, CA (US)

(73) Assignee: ZODIAC POOL SYSTEMS LLC, Carlsbad, CA (US)

( * ) Notice: Subject to any disclaimer, the term of this patent is extended or adjusted under 35 U.S.C. 154(b) by 367 days.

(21) Appl. No.: 18/102,496

(22) Filed: Jan. 27, 2023

(65) Prior Publication Data

US 2024/0254796 A1 Aug. 1, 2024

(51) Int. Cl.
*E04H 4/16* (2006.01)

(52) U.S. Cl.
CPC ..... *E04H 4/1654* (2013.01); *E04H 4/1636* (2013.01)

(58) Field of Classification Search
CPC ..... E04H 4/16; E04H 4/1636; E04H 4/1654
See application file for complete search history.

(56) References Cited

U.S. PATENT DOCUMENTS

| | | | |
|---|---|---|---|
| 2,923,954 A | 2/1960 | Babcock | |
| 3,012,676 A | 12/1961 | Englesberg | |
| 3,349,919 A | 10/1967 | Royer et al. | |
| 6,206,547 B1 | 3/2001 | Erlich | |
| 6,412,133 B1 | 7/2002 | Erlich et al. | |
| 8,627,533 B2 | 1/2014 | Pichon et al. | |
| 9,670,688 B2 | 6/2017 | Erlich | |
| 10,246,894 B2 | 4/2019 | Deloche et al. | |
| 10,494,829 B2 | 12/2019 | Lavabre | |
| 11,821,233 B2 | 11/2023 | van der Meijden et al. | |
| 2002/0129839 A1 | 9/2002 | Erlich et al. | |
| 2009/0277821 A1 | 11/2009 | Hui | |
| 2011/0154586 A1 | 6/2011 | Mastio et al. | |
| 2011/0203060 A1 | 8/2011 | Pichon et al. | |
| 2016/0104359 A1* | 4/2016 | AlMahmoud | G01S 7/539 367/112 |
| 2016/0145885 A1 | 5/2016 | Hui et al. | |
| 2016/0153210 A1 | 6/2016 | Sebor et al. | |

(Continued)

FOREIGN PATENT DOCUMENTS

| | | |
|---|---|---|
| CN | 101666168 B | 1/2011 |
| CN | 207348537 U | 5/2018 |

(Continued)

OTHER PUBLICATIONS

U.S. Appl. No. 17/185,220, Final Office Action mailed on Mar. 20, 2023, 8 pages.

(Continued)

*Primary Examiner* — Michael D Jennings
(74) *Attorney, Agent, or Firm* — Kilpatrick Townsend & Stockton LLP

(57) ABSTRACT

Described are apparatus, systems, and methods of improving cleaning of, e.g., stairs of swimming pools. Automatic swimming pool cleaners (APCs) capable of autonomous movement within water-containing vessels may be utilized to provide enhanced cleaning of sections of the vessels containing stairs or other angled surfaces.

20 Claims, 14 Drawing Sheets

(56) References Cited

U.S. PATENT DOCUMENTS

| | | | | |
|---|---|---|---|---|
| 2017/0362845 | A1* | 12/2017 | Korenfeld | E04H 4/1654 |
| 2018/0135325 | A1* | 5/2018 | Schloss | E04H 4/1654 |
| 2018/0155947 | A1 | 6/2018 | Hayes et al. | |
| 2019/0040642 | A1* | 2/2019 | Michelon | E04H 4/1654 |
| 2019/0345728 | A1 | 11/2019 | Adlivankin et al. | |
| 2019/0360226 | A1* | 11/2019 | Schloss | E04H 4/1654 |
| 2020/0056890 | A1* | 2/2020 | Newman | G01S 5/16 |
| 2021/0241597 | A1* | 8/2021 | Gali | G06V 20/52 |
| 2021/0277678 | A1 | 9/2021 | van der Meijden et al. | |
| 2022/0080600 | A1* | 3/2022 | Kearns | G01S 17/93 |
| 2022/0333395 | A1* | 10/2022 | Chafik | E04H 4/1654 |
| 2023/0175279 | A1* | 6/2023 | Deng | E04H 4/1654 700/245 |

FOREIGN PATENT DOCUMENTS

| | | | | |
|---|---|---|---|---|
| CN | 210032784 | U | 2/2020 | |
| CN | 112112452 | A | 12/2020 | |
| EP | 0483677 | A2 | 5/1992 | |
| EP | 0989256 | A1 | 3/2000 | |
| EP | 1905925 | A2 | 4/2008 | |
| EP | 2829937 | A1 | 1/2015 | |
| EP | 2960741 | A2 | 12/2015 | |
| EP | 3023561 | A1 | 5/2016 | |
| EP | 3293324 | A1 | 3/2018 | |
| EP | 3604712 | A1 * | 2/2020 | E04H 4/1654 |
| FR | 2934630 | A1 | 2/2010 | |
| WO | 2016209973 | A1 | 12/2016 | |
| WO | 2017108541 | A1 | 6/2017 | |
| WO | WO-2017216784 | A1 * | 12/2017 | E04H 4/1654 |
| WO | 2021183296 | A1 | 9/2021 | |

OTHER PUBLICATIONS

U.S. Appl. No. 17/185,220, Titled: Automatic Swimming Pool Cleaners Especially Adept at Climbing and Cleaning Pool Stairs filed Feb. 25, 2021, 49 pages.
U.S. Appl. No. 17/185,220, Advisory Action mailed on Jun. 5, 2023, 4 pages.
U.S. Appl. No. 17/185,220, Notice of Allowance mailed on Aug. 4, 2023, 8 pages.
English translation of CN 112112452 mailed on Dec. 22, 2020, 7 pages.
U.S. Appl. No. 17/185,220, Non-Final Office Action mailed on Oct. 25, 2022, 14 pages.
International Application No. PCT/US2021/019623, International Preliminary Report on Patentability mailed on Sep. 22, 2022, 13 pages.
International Application No. PCT/US2021/019623, International Search Report and Written Opinion mailed on Aug. 9, 2021, 18 pages.
International Application No. PCT/US2021/019623, Invitation to Pay Additional Fees and, Where Applicable, Protest Fee mailed on Jun. 18, 2021, 5 pages.
European Application No. 21713254.7, Office Action mailed on Sep. 25, 2024, 9 pages.
International Application No. PCT/US2024/013028, Invitation to Pay Additional Fees and, Where Applicable, Protest Fee mailed on May 27, 2024, 11 pages.
International Application No. PCT/US2024/013028, International Search Report and Written Opinion mailed on Jul. 18, 2024, 18 pages.
European Application No. 21713254.7, Office Action mailed on Jun. 19, 2024, 4 pages.
Australian Application No. 2021234221, Notice of Acceptance mailed on Sep. 2, 2025, 3 pages.
Australia Application No. 2021234221, Second Examination Report mailed on Jul. 21, 2025, 5 pages.
International Patent Application No. PCT/US2024/013028, Notification Concerning International Preliminary Report on Patentability, Aug. 7, 2025, 12 pages.
Machine-generated English Translation of CN 101666168 B mailed on Jan. 12, 2011, 26 pages.
Machine-generated English translation of FR 2934630 mailed on Feb. 5, 2010, 40 pages.
U.S. Appl. No. 18/381,552, Non-Final Office Action mailed on Oct. 21, 2025, 18 pages.
European Application No. 21713254.7, Office Action mailed on Sep. 25, 2025, 5 pages.
English Translation of WO 2017108541 A1, Jun. 29, 2017, 47 pages.
U.S. Appl. No. 18/381,552, Final Office Action mailed on Mar. 17, 2026, 14 pages.

* cited by examiner

AUTOMATIC SWIMMING POOL CLEANERS ESPECIALLY ADEPT AT CLIMBING AND CLEANING POOL STAIRS

FIELD OF THE INVENTION

This invention relates to cleaning devices capable of autonomous movement in water-containing vessels such as swimming pools or spas and more particularly, although not necessarily exclusively, to cleaners, systems, and methods providing enhanced cleaning of sections of the vessels containing stairs or other angled surfaces.

BACKGROUND OF THE INVENTION

U.S. Patent Application Publication No. 2019/0345728 of Adlivankin, et al., whose entire contents are incorporated herein by this reference, describes an automatic swimming pool cleaner (APC) with a tilt sensor and a controller "configured to detect ascending or descending a stair of [a pool] stairway in accordance with a sensed tilt of the pool cleaner." See Adlivankin, p. 1, ¶ 0006. The APC also may include a depth sensor similarly "configured to detect ascending or descending a stair of the stairway." See id., ¶ 0011. When the cleaning device has ascended to a highest permissible stair, the controller either stops operation of the device or reverses its direction of motion. See id., ¶¶ 0013-0016.

Absent from the Adlivankin application is any description of structures designed to facilitate climbing and improve cleaning of, for example, stairs or other angled sections of pools or spas. Hence, although the APC of the Adlivankin application may recognize when it has ascended or descended a stair and stop operation or reverse direction accordingly, the cleaner otherwise is structured conventionally. If a stair is narrow or longer than the width of the APC, the cleaner of the Adlivankin application is unlikely to clean it effectively.

SUMMARY OF THE INVENTION

The present invention provides apparatus, systems, and methods for improving cleaning of, e.g., these types of stairs.

According to certain embodiments, an APC includes a body, motive elements configured to move the body along a surface of a swimming pool, and a sensor for tracking a distance travelled by the APC.

According to various embodiments, an APC includes a body, motive elements configured to move the body along a surface of a swimming pool, a pressure sensor configured to detect a depth of the APC in the swimming pool, and a controller configured to maintain the depth of the APC based on the detected depth from the pressure sensor.

According to certain embodiments, an APC includes a body, motive elements configured to move the body along a surface of a swimming pool and in a first direction, and a sensor oriented in a second direction that is different from the first direction, the sensor configured to detect a distance or proximity in the second direction.

According to some embodiments, a method of cleaning walls of a swimming pool includes causing operation of an APC and controlling the APC to clean in a horizontal direction along the walls of the swimming pool based on a depth detected by the pressure sensor.

According to various embodiments, a method of cleaning a surface of a swimming pool includes causing operation of an APC and tracking a distance travelled by the APC using a sensor.

According to certain embodiments, a method of cleaning a swimming pool includes climbing (or causing to climb) a plurality of steps in a going up direction by an APC, determining, by the APC, when the APC is at a highest step of the plurality of steps, and cleaning, by the APC, the plurality of steps in a going down direction.

According to various embodiments, a method of cleaning a swimming pool includes cleaning (or causing to clean) a run of a step by advancing an APC towards an edge of the run of the step and altering movement and/or a direction of the APC upon a detection, by a sensor of the APC, of the edge of the run of the step.

According to some embodiments, a method of cleaning a swimming pool includes cleaning (or causing to clean) a run of a step by advancing the APC towards an edge of the run of the step using an APC, and altering a direction of the APC based on an approach of the APC to the edge of the run of the step or an approach of the APC to a rise or vertical wall.

According to certain embodiments, an APC includes a bypass valve assembly with a valve door, a float, and an actuator arm linking the valve door to the float. The bypass valve assembly is configured to selectively open or close a bypass opening based on an orientation of the APC.

Various implementations described herein can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

DETAILED DESCRIPTION

Figure 1:
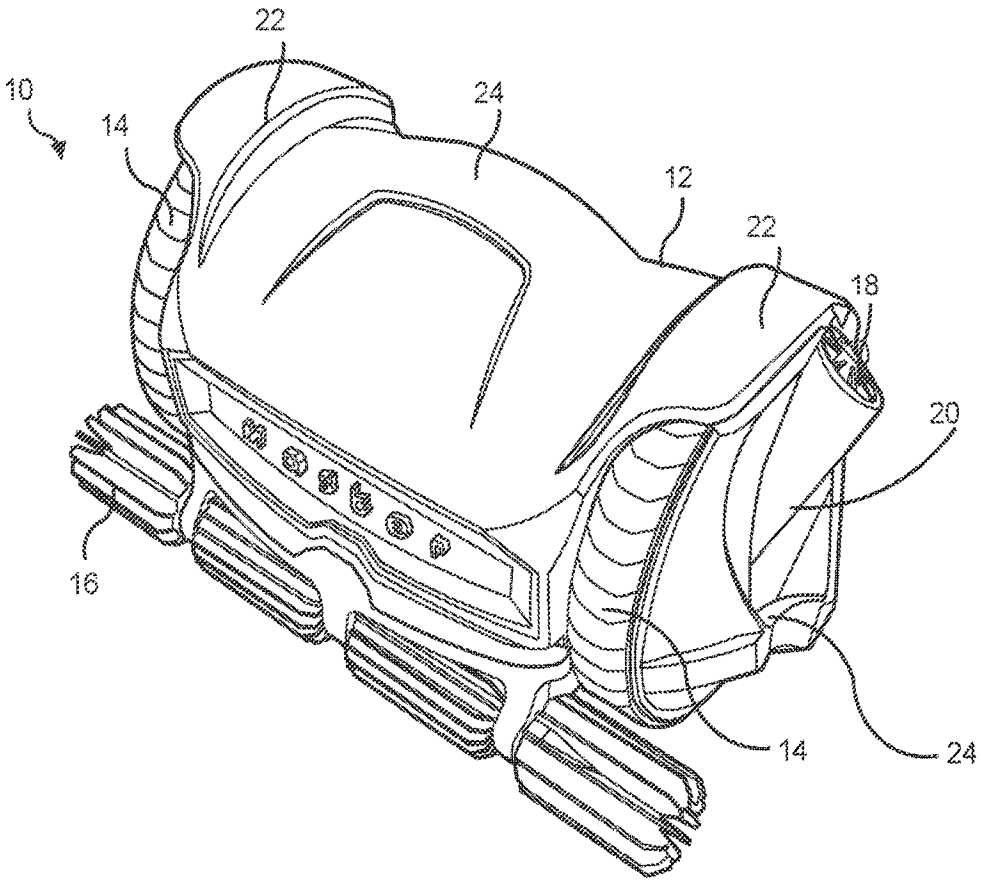
FIG. 1 illustrates an APC according to embodiments.

Described herein are APCs and associated systems and methods for providing improved cleaning of a swimming pool or spa.

In certain embodiments, the APCs described herein may include one or more sensors, and the APCs advantageously may be controlled based on information from such sensors. Non-limiting examples of such sensors are discussed below, and the skilled person will appreciate that various combinations of sensors and/or other sensors or combinations of sensors may be utilized as desired. In some embodiments, the APCs described herein include means for tracking a distance travelled by the APC along a surface of the swimming pool or spa. Such tracking means may include, but are not limited to, one or more optical flow sensors carried on, in, or by the body of the APC. In various embodiments, APCs described herein include means for detecting a depth of the APC, such as but not limited to a pressure sensor and/or a depth sensor. In such embodiments, a horizontal and/or vertical position and/or movement of the APC may be controlled based on the detected depth of the APC. According to certain embodiments, APCs described herein include one or more sensors for detecting a distance and/or proximity of the APC in one or more directions. In such embodiments, the one or more directions may be a direction of movement, a direction, an oblique angle or orthogonal angle to the direction of movement, and/or any other direction or combination of directions as desired.

In various embodiments, the APCs described herein may provide improved cleaning of features of the swimming pool or spa with surfaces that are not necessarily in a same plane, such as but not limited to stairs of the pool, a bench of the pool, etc. In some non-limiting examples, a method of cleaning a swimming pool includes cleaning the steps in a "going up" direction, meaning that APC starts on the bottom surface of the pool, cleans a wall (rise) of a step, climbs up the step and cleans all along the floor (run) of the step horizontally/diagonally, and repeats as needed. In various embodiments, the APC may determine when the APC is at a highest step that it can access, and then perform cleaning in a "going down" direction. In other embodiments, the APC may climb stairs in a going up direction and without cleaning the steps, determine when the APC is at the highest step, and then perform cleaning in the going down direction. With the APCs provided herein, the stairs can be cleaned one step at a time because of the size and/or profile of the cleaner and the independently controlled thrust for improved movements (e.g., shuffling, pivoting, etc.), which may provide an improved cleaning of the stairs compared to traditional APCs that are too big to clean one step at a time and/or lack sufficient navigation control.

According to various embodiments, an improved cleaning method may include cleaning, by the APC, a run of a step by advancing the APC towards an edge of the run of the step, and altering movement and/or a direction of the APC based on a detection of the edge of the run of the step, an approach of the APC to the edge of the run of the step, and/or an approach of the APC to a rise or vertical wall.

Various other benefits and advantages may be realized with the devices and methods provided herein, and the aforementioned advantages should not be considered limiting.

Figure 2:
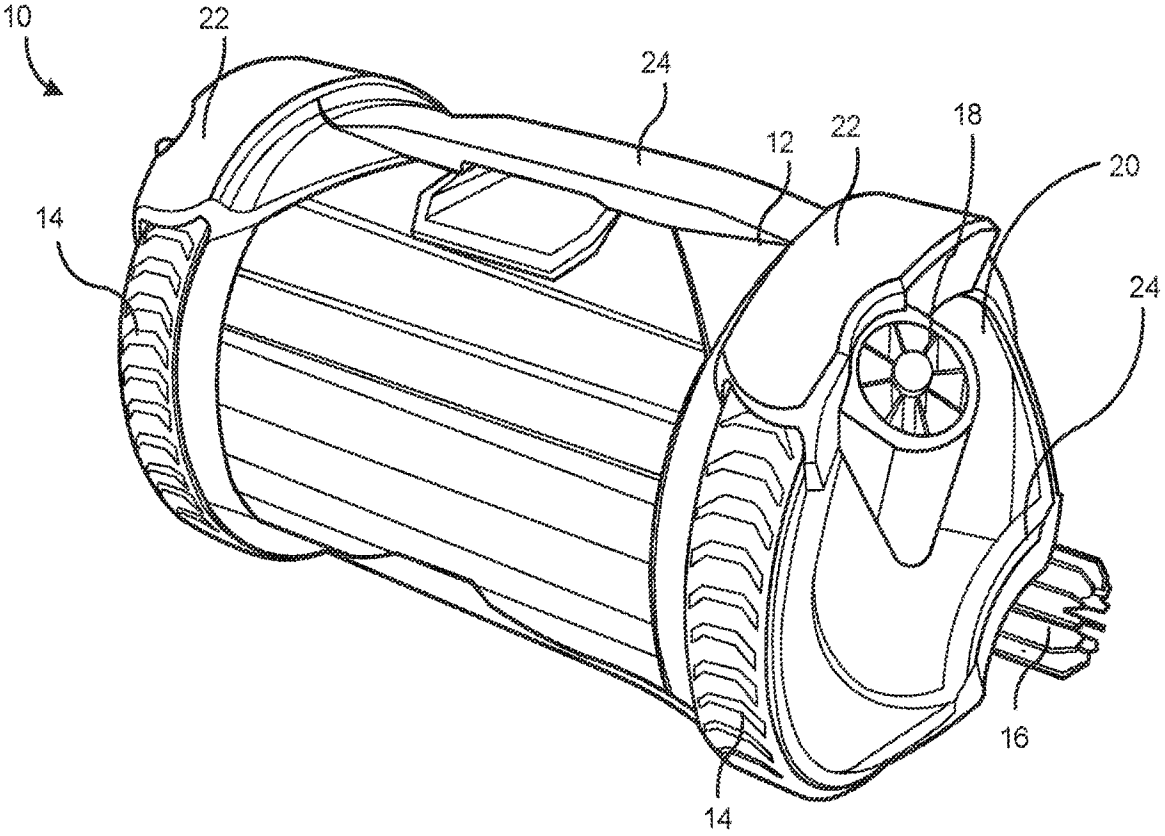
FIG. 2 is another perspective view of the APC of FIG. 1.

FIGS. 1 and 2 illustrate an APC 10 according to embodiments. The APC 10 generally includes a body 12, motive elements 14, and a brush assembly 16. The APC 10 also may include one or more inlets, one or more outlets 18, a filter assembly, a pump, a motor, a controller (processor and/or memory), one or more sensors, an onboard power source, and/or various sub-combinations of features and/or additional features as desired. In certain embodiments, the body 12 has a generally cylindrical shape with a maximum diameter approximating that of motive elements 14. Such a shape of the APC 10 may facilitate cleaning operations as discussed in detail below. The motive elements 14 may be various devices for facilitating movement of the APC 10 along a surface (e.g., wheels, tracks, rollers, etc.), and in the embodiment illustrated, the motive elements 14 are wheels. Optionally, covers 22 may at least partially cover the motive elements 14. In use, the covers 22 may at least partially protect the motive elements 14 from potential interference in a direction opposite the surface on which the APC 100 is travelling. Optionally, the APC 10 may include one or more handles 24, such as but not limited to on the body 12, on hubs 20 for the motive elements 14, and/or other locations as desired.

In certain embodiments, in addition to performing a cleaning operation, the brush assembly 16 may be used to orient the APC 10. In such examples, the brush assembly 16 may function as another motive element of the APC 10.

In certain embodiments, the brush assembly 16 may be in close proximity to the motive elements 14, thereby giving the APC 10 a compact footprint in a front-to-back direction. In certain embodiments, relative to a surface that the APC 10 is moving along, the brush assembly 16 may be "tucked under" the motive elements 14, which may make the APC 10 compact from the point-of-contact point of the motive elements 14 with the surface to the tip of the brush assembly 16. Such a compact assembly may allow the APC 10 to be at locations within a pool that traditionally were difficult or not possible for cleaners to reach. As a non-limiting example, the compact assembly of the APC 10 may allow the APC 10 to sit on a narrow stair while still having room to maneuver. In certain embodiments, the compact relationship between the brush assembly 16 and the motive elements 14 optionally may allow for the body 12 of the APC 10 to have an improved shape (e.g., so that the body 12 does not make contact when the APC 10 is moving between two surfaces such as a rise and a run of a step). As an example, the motive elements 14 may be on a first surface and the brush assembly 16 may be on a second surface that is not parallel to the first surface. In such an example, while the brush assembly 16 and the motive elements 14 are on different surfaces, the body 12 may not make contact with a surface of the pool.

Figure 3:
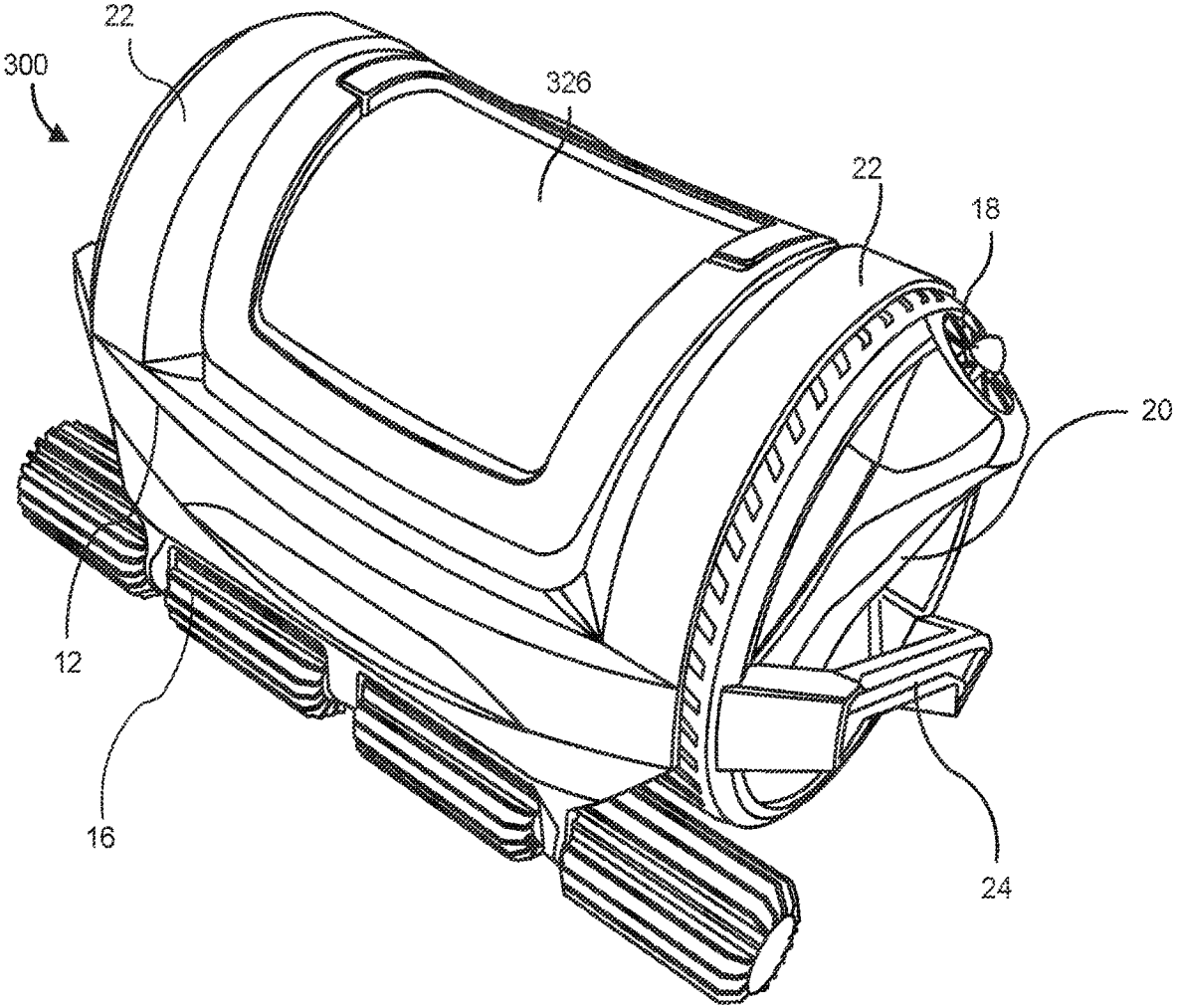
FIG. 3 is a perspective view of an APC according to embodiments.
Figure 4:
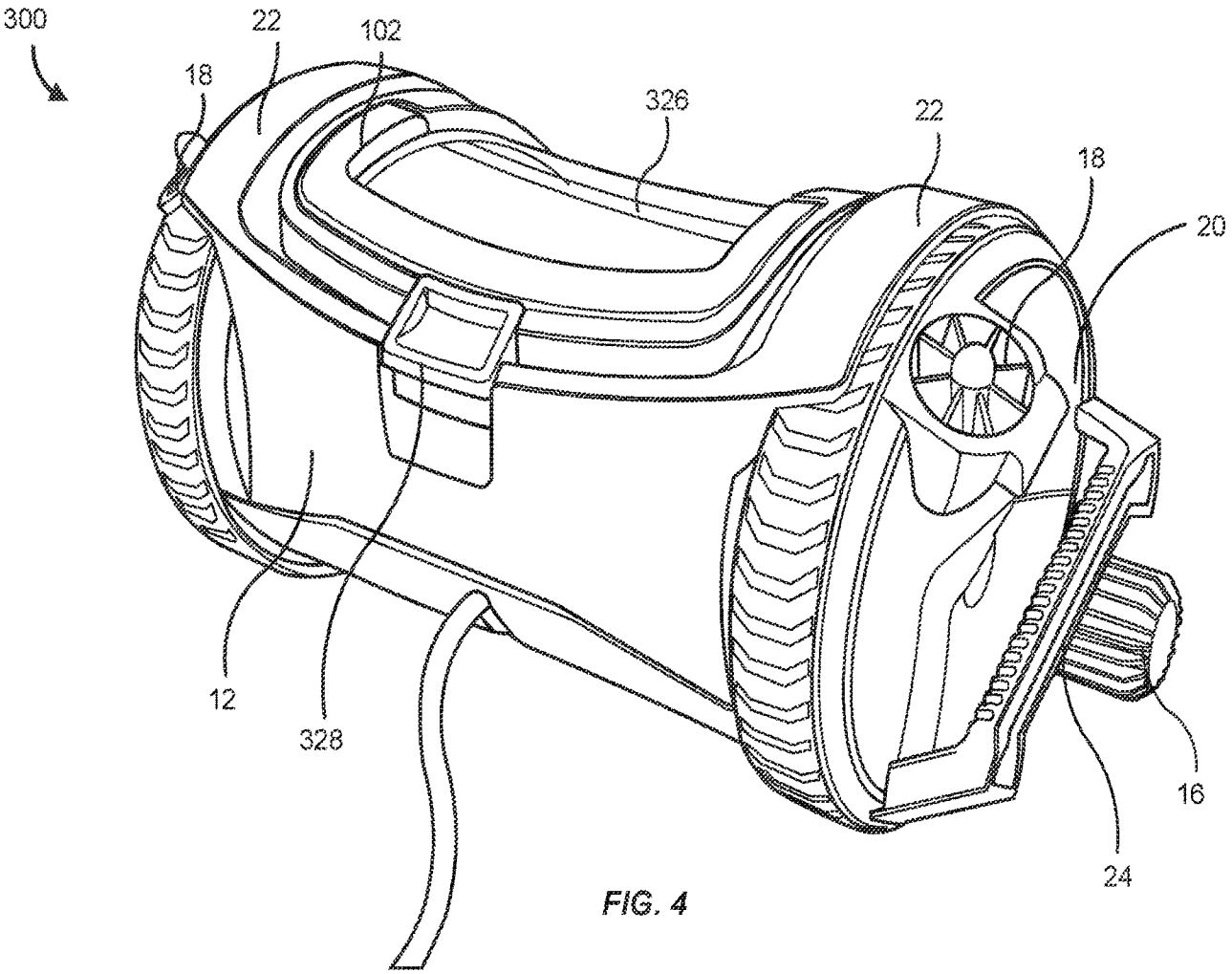
FIG. 4 is another perspective view of the APC of FIG. 3.

FIGS. 3 and 4 illustrate another example of an APC 100 according to embodiments. The APC 100 is similar to the APC 10 except that the APC 100 additionally includes a door or cover 326 that is movable relative to the body 12 between a closed position and an open position such that a user can selectively access components within the body 12. FIGS. 3 and 4 illustrate the cover 326 in the closed position. In some embodiments, the cover 326 optionally may be constructed from a transparent and/or semitransparent material such that a user may view components within the body 12 through the cover 326 while the cover 326 is in the closed position. The cover 326 may be movable relative to the body 12 using various mechanisms or devices as desired. Optionally, a locking mechanism 328, such as but not limited to a latch, may selectively secure the cover 326 in the closed position relative to the body 12.

The APCs 10, 100 are provided for illustrative purposes, and in other embodiments, APCs may include additional and/or fewer components as desired. Non-limiting examples of other APCs are disclosed in U.S. patent application Ser. No. 17/185,220 to Van der Meijden et al., titled "Automatic Swimming Pool Cleaners Especially Adept At Climbing and Cleaning Pool Stairs" and filed on Feb. 25, 2021, the content of which is hereby incorporated by reference in its entirety.

APCs with Sensors

In some embodiments, the APCs provided herein optionally may include one or more sensors located and/or oriented in one or more directions. Optionally, a direction or orientation of at least one sensor is different than the direction of travel of the APC. Such sensors may have sensing regions and/or otherwise be configured to sense or detect in a direction other than the first direction (e.g., the direction of travel). In various embodiments, the sensors may be configured to sense or detect information in a direction other than a vertical direction of the APC. The orientation of the sensors may be at various angles relative to the direction of travel, including angles of greater than 0° and less than 180°, such as an angle from about 15° to about 165°, such as an angle from about 10° to about 150°, such as an angle from about 45° to about 135°, such as an angle from about 60° to about 120°, such as an angle from about 75° to about 105°, such as an angle of about 90°. The sensors may be provided at other angles as desired, and when a plurality of sensors are included, the angle of orientation of one sensor need not be the same as the angle of orientation of another sensor.

In some examples, the sensors may be provided on the hubs 20 and/or other suitable locations as desired, and in such embodiments the sensors may be "side" sensors. However, in other embodiments, the sensors may be provided at various locations on the APC as desired while having sensing regions other than in the direction of travel.

The sensors may be various types of sensors and/or combinations of types of sensors as desired, including but not limited to distance sensors, accelerometers, gyroscopes, tilt sensors, depth sensors, pressure sensors, location sensors, orientation sensors, sensors for measuring a water characteristic, combinations thereof, and/or other sensors or combinations of sensors as desired. In certain embodiments, the sensors may be various types of sensors as desired capable of sensing, among other things, information relating to objects which APC is approaching (e.g., a wall, piece of equipment, etc.). In some non-limiting examples, the sensors may be distance sensors oriented in the direction perpendicular to the direction of travel of the APC. The sensors may be utilized in certain embodiments to sense walls during a cleaning operation and/or movement of the APC, particularly when the APC is on a stair. In some examples, the sensors may facilitate detection of a stair edge. As a non-limiting example, the sensors on one end of the APC may detect a proximity or minimum distance between the APC and a wall, and the APC may determine an adjacent wall of the stair forming the corner via a forward facing sensor, inability to move forward, etc.

In some embodiments, one or more of the APCs described herein includes one or more pressure (depth) sensors to facilitate horizontal positioning and/or movement of the APC within the pool, particularly on a wall of the pool. As a non-limiting example, the pressure sensor may detect the APC is at a certain depth or vertical height. In this embodiment, the APC may be controlled (e.g., using a controller onboard the APC) based on the data from the pressure sensor such that the APC travels at the vertical height around all the walls of the pools. After the APC travels the desired horizontal path at the vertical height, the APC may change its depth or vertical height. In such embodiments, the APC may adjust its depth or vertical height based on the data from the pressure sensor (e.g., it determines it is at the next vertical height for cleaning), and once at the new vertical height, travel along another horizontal path around all walls of the pool at the new vertical height. The pressure sensor may be used to perform various other controls of the APC during travel and/or cleaning as desired.

In certain embodiments, the APCs described herein optionally may include an optical flow sensor for tracking movement of the APC in two directions (e.g., an x direction and a y direction) along a surface and/or a distance travelled by the APC. In such embodiments, the optical flow sensor may include an optical sensor (e.g., a camera and/or other suitable device or sensor) directed at the surface that the APC is travelling along. In various embodiments, the optical flow sensor includes a light source directed at the surface being measured. In certain embodiments, the optical flow sensor may be oriented directly down, preferably (although not required) 90 degrees to the surface that it is moving over. In such embodiments, the optical flow sensor may track the movement of discernible features and a speed at which they pass relative to the optical flow sensor. The optical flow sensor includes an accompanying light source, including, but not limited to, a light emitting diode (LED), to selectively illuminate the surface over which the APC the travelling. An intensity of the light emitted from the light source may be adjusted based on ambient light detected (e.g., by a light receiver of the flow sensor). In some embodiments, the intensity of the light may be automatically adjusted, although it need not be in other embodiments. Optionally, a controller (e.g., of the optical flow sensor and/or of the APC) may control an intensity of the light source as desired, and in certain embodiments the intensity of the light source is controlled based on a distance between the optical flow sensor and the surface.

In some embodiments, the APC may be controlled such that the optical flow sensor is maintained at a predetermined distance relative to the surface, which may improve an accuracy of the information detected and gathered by the optical flow sensor. In one non-limiting example, the APC may be controlled to be at a predetermined distance of 10 mm-40 mm, for example, 15 mm-38 mm, inclusive, from the surface, although in other embodiments the APC may be controlled to various other distances as desired. In certain embodiments, the optical flow sensor may be provided on a portion of the APC which may generally maintain the predetermined distance relative to the surface. In some non-limiting examples, the optical flow sensor may be provided on a motive element 13, hub 20, bottom surface of the body 12, scrubber, and/or any other portion of the APC as desired.

In various embodiments, an additional sensor (e.g., proximity sensor, distance sensor, etc.) may be utilized in conjunction with the optical flow sensor. Suitable sensors may include, but are not limited to, an ultrasonic proximity sensor, a light-intensity proximity sensor, LIDAR or a time-of-flight (TOF) sensor (measures the time a pulsed light takes to bounce back to the sensor), combinations thereof, and/or other sensors as desired. In two non-limiting examples, the optical flow sensor may be used in combination with a distance sensor such as a TOF sensor or a light intensity distance sensor. In certain embodiments, the optical flow sensor may be calibrated based on readings from the distance sensor. As non-limiting examples, the additional sensor may measure a distance to the surface, and based on the measured distance from the additional sensor, the data from the optical flow sensor may be adjusted and/or corrected, and/or the optical flow sensor itself may be adjusted (e.g., by controlling an intensity of the light source, focus of a lens of the sensor, etc.).

In some embodiments, if the APC includes the light intensity distance sensor, the light intensity distance sensor optionally may self-calibrate based on its light intensity reading and a known distance from the sensor to the pool floor (assuming the APC is not moving and is sitting on the floor).

The aforementioned sensors are for illustrative purposes, and in other embodiments, the APCs described herein may include additional and/or fewer sensors as desired.

Cleaning Operations

In certain embodiments, APCs consistent with the disclosure may perform cleaning actions during which the APCs alter their movement and/or a direction of travel. While the following description makes reference to the APC 10, the description is applicable to the APCs consistent with the disclosure.

In one embodiment, the APC 10 may selectively flip over to reverse a direction of travel. However, in other embodiments, the APC 10 need not flip over to change a direction of travel and/or alter its movement, and the APC 10 may perform other actions to change its direction of travel and/or alter its movement.

Figure 5:
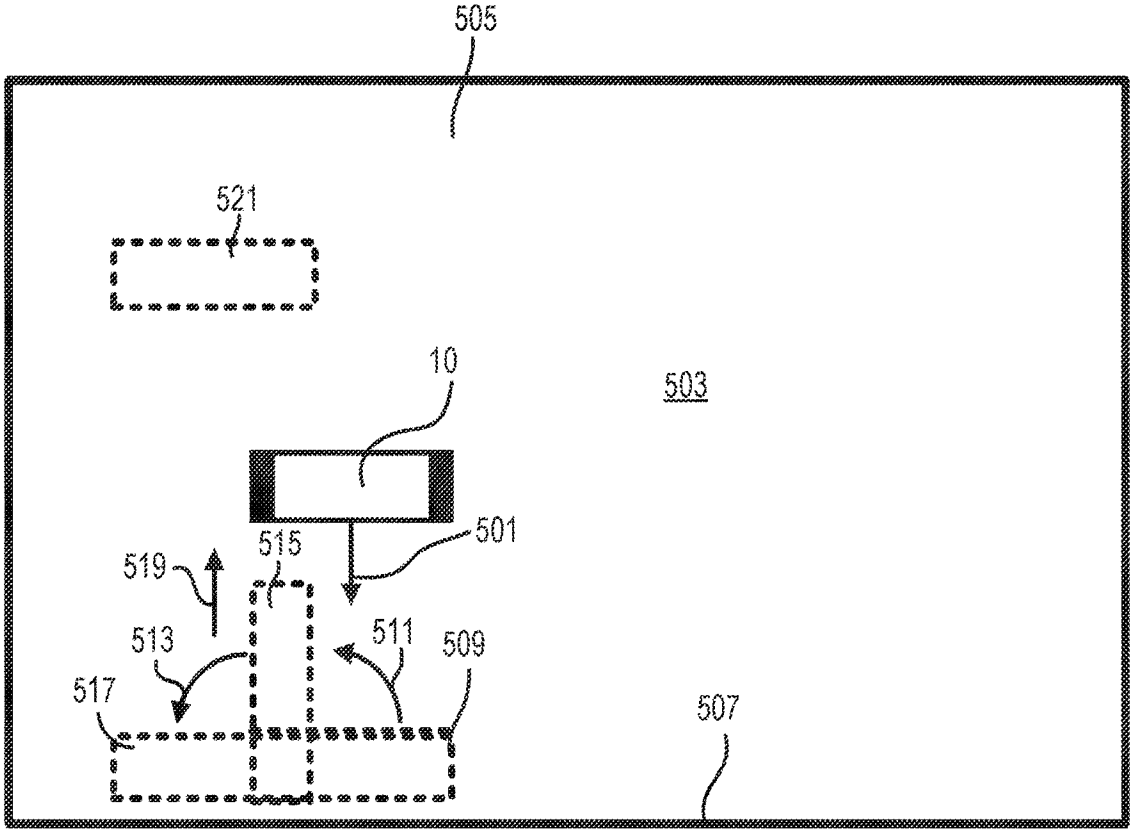
FIG. 5 illustrates an exemplary cleaning pattern performed by an APC according to embodiments.

As a non-limiting example, and referring to FIG. 5, the APC 10 may perform a pivot action to change its direction of travel and/or alter its movement. In such embodiments, one of the motive elements 14 may be driven while the other motive element 14 is fixed and/or not driven such that the APC rotates about the motive element 14 that is fixed and/or not driven. As illustrated in FIG. 5, in various embodiments, the APC 10 may be moving in a direction of travel 501 along a surface 503 of a pool 505. Upon detection of a wall 507 (represented by position 509), the APC 10 may generate thrust and/or otherwise drive itself (e.g., using the motive elements, pumps, etc.) such that it pivots about one of its ends (represented by arrows 511 and 513 as well as positions 515 and 517). In the pivoted position 517, the APC 10 may continue along a new direction of travel 519 (e.g., to position 521). The cleaning operation illustrated in FIG. 5 should not be considered limiting, and the APCs described herein may perform various other cleaning operations as desired.

Figure 6:
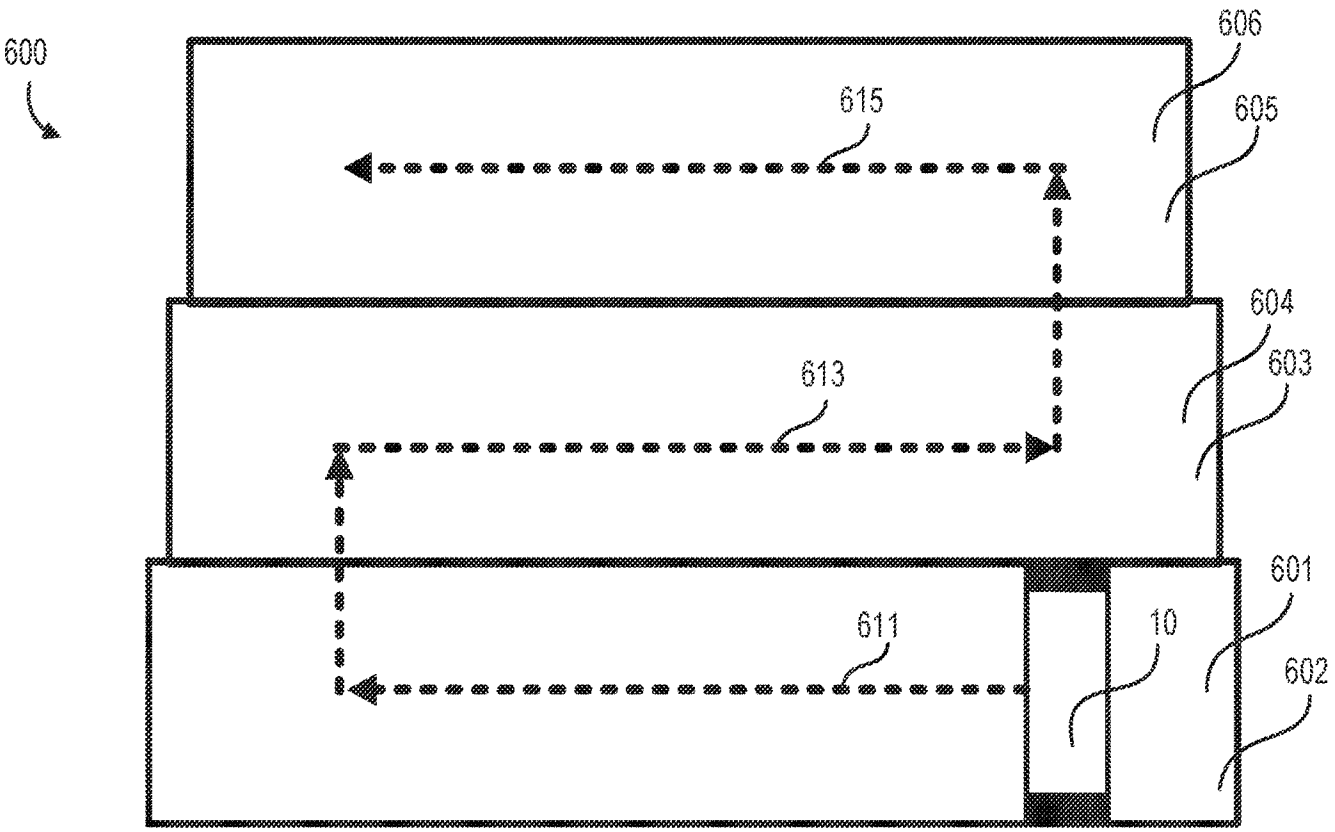
FIG. 6 illustrates another exemplary cleaning pattern performed by an APC according to embodiments.

Referring to FIG. 6, in some embodiments, the APC 10 may perform one or more cleaning operations on stairs 600. In the embodiment illustrated, the stairs 600 include three steps 601, 603, 605, where the step 601 is the lowermost step (e.g., step closest to a floor of the pool) and the step 605 is a topmost step (e.g., step closest to a surface of the pool). As illustrated in FIG. 6, the APC 10 may clean the stairs 600 in a "going up" direction, meaning that the APC 10 starts on the bottom surface of the pool, cleans a wall (rise) 602 of the stair 601 (represented by arrow 611), climbs up the stair 601 and cleans all along the floor (run) of the stair 601 horizontally/diagonally, and repeats as needed. In the example illustrated, the APC 10 subsequently cleans the rise 604 of the stair 603, then the run of the stair 603, then the rise 606 of the stair 605, and lastly the run of the stair 605 (if such a run exists). In various embodiments, the APC 10 may determine when the APC 10 is at a highest step that it can access, and then perform cleaning in a "going down" direction. In other embodiments, the APC 10 may climb stairs in a going up direction and without cleaning the steps, determine when the APC 10 is at the highest step, and then perform cleaning in the going down direction. With the APC 10, the stairs 600 can be cleaned one step at a time because of the size and/or profile of the cleaner and the independently controlled thrust for improved movements (e.g., shuffling, pivoting, etc.), which may provide an improved cleaning of the stairs compared to traditional APCs that are too big to clean one step at a time and/or lack sufficient navigation control.

Figure 7:
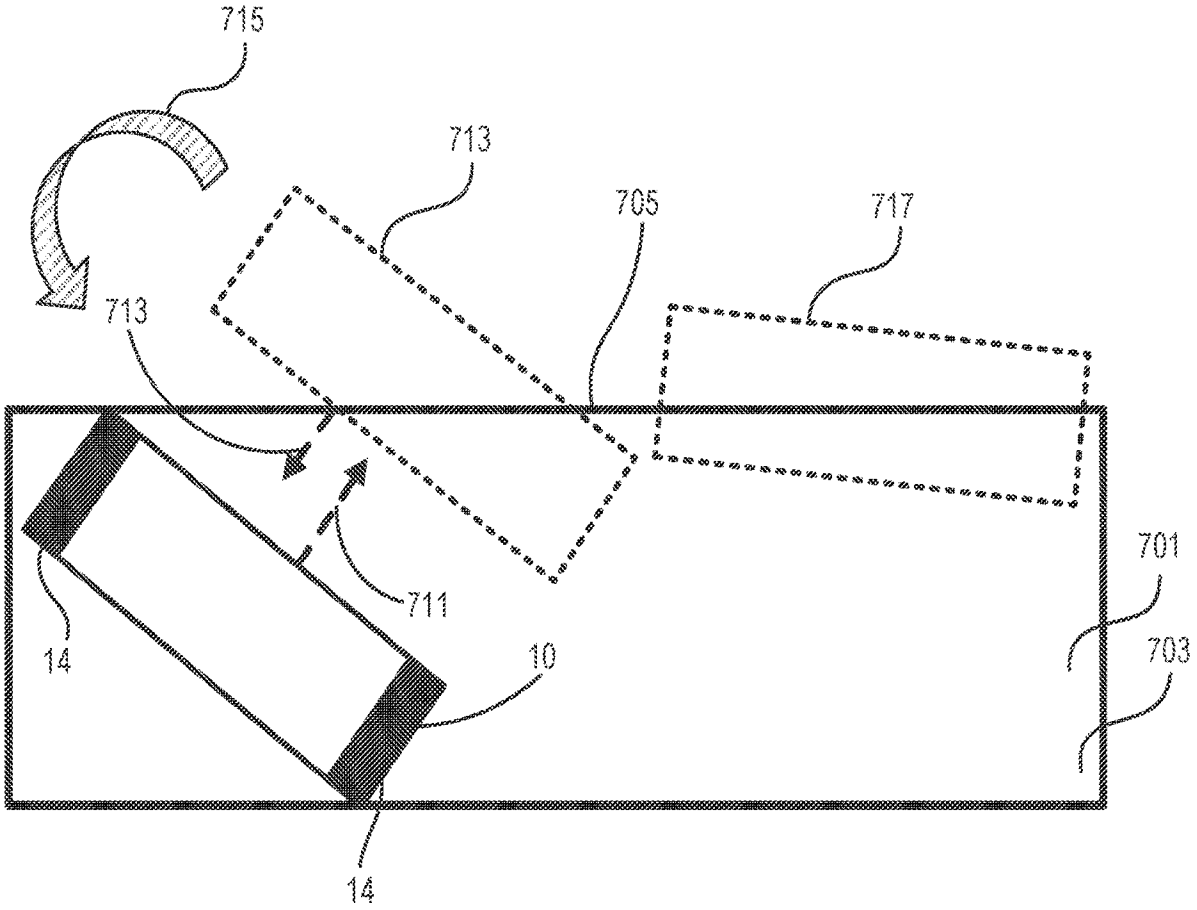
FIG. 7 illustrates another exemplary cleaning pattern performed by an APC according to embodiments.

As another non-limiting example and referring to FIG. 7, the APC 10 optionally may clean stairs while minimizing and/or preventing the APC 10 from falling off an edge of the stair. FIG. 7 is a plan view of a step 701 such that a run 703 of the step 701 is visible as well as an edge 705 of the step 701. In this embodiment and as discussed in detail below, the APC 10 may flip itself over and/or change its orientation and/or alter its movement upon detection of the edge 705 of the step 701 (e.g., via a sensor detecting a lack of a surface, etc.).

In certain embodiments, the APC 10 may alter its orientation and/or movement and cause itself to travel away from the edge of the run of the step or away from the rise. In various embodiments, the APC 10 may alter its orientation and/or movement by causing itself to remain on the run of the step. In some embodiments, and as illustrated in FIG. 7, the APC 10 may be controlled pursuant to a cleaning pattern where the APC 10 approaches the edge 705 of the step 701 at an oblique angle (represented by arrow 711). In such embodiments, an accelerometer and/or other sensor 719 of the APC 10 may sense when one motive element 18 is going off the edge 705 of the step 701 (see, e.g., position 713). As a non-limiting example, the sensor may recognize a bump as an indication that the motive element 18 is going off the edge 705 of the step 701. In other embodiments, part of the APC 10 (e.g., a motive element) need not move over the edge 705 of the step 701. In such embodiments, the APC 10 may include a tilt sensor (e.g., an accelerometer, level sensor, presence sensor, distance sensor, and/or other suitable sensor) that may detect tilting of the APC 10 and recognize the edge of the step.

Regardless of how the APC 10 recognizes the edge of the step, based on such a detection, the APC 10 may stop movement in that direction and may move itself in the opposite direction such that it does not fall off the edge 705 of the step 701 (represented by arrow 713), or otherwise remains on the step 701. Optionally, based on such a detection, the APC 10 may adjust its orientation (e.g., by controlling thrust from one of the pumps) (represented by arrows 715 and orientation 717, which is illustrated offset from where the APC 10 would actually be for clarity of the figure). Such adjustment may minimize the possibility of the APC 10 falling off the edge 705 prior to advancing away from the edge 705. In certain optional embodiments, the APC 10 may halt a cleaning operation upon detection that it is going off/approaching the edge 705 of the step 701 (e.g., based on the detected bump or detected tilt) and may restart the cleaning operation based on movement in the opposite direction and/or the subsequent detection of the edge (e.g., the bump) again. In other embodiments, the APC 10 may perform other cleaning operations on the stairs, including but not limited to the pivoting movement illustrated in FIG. 5.

Figure 8:
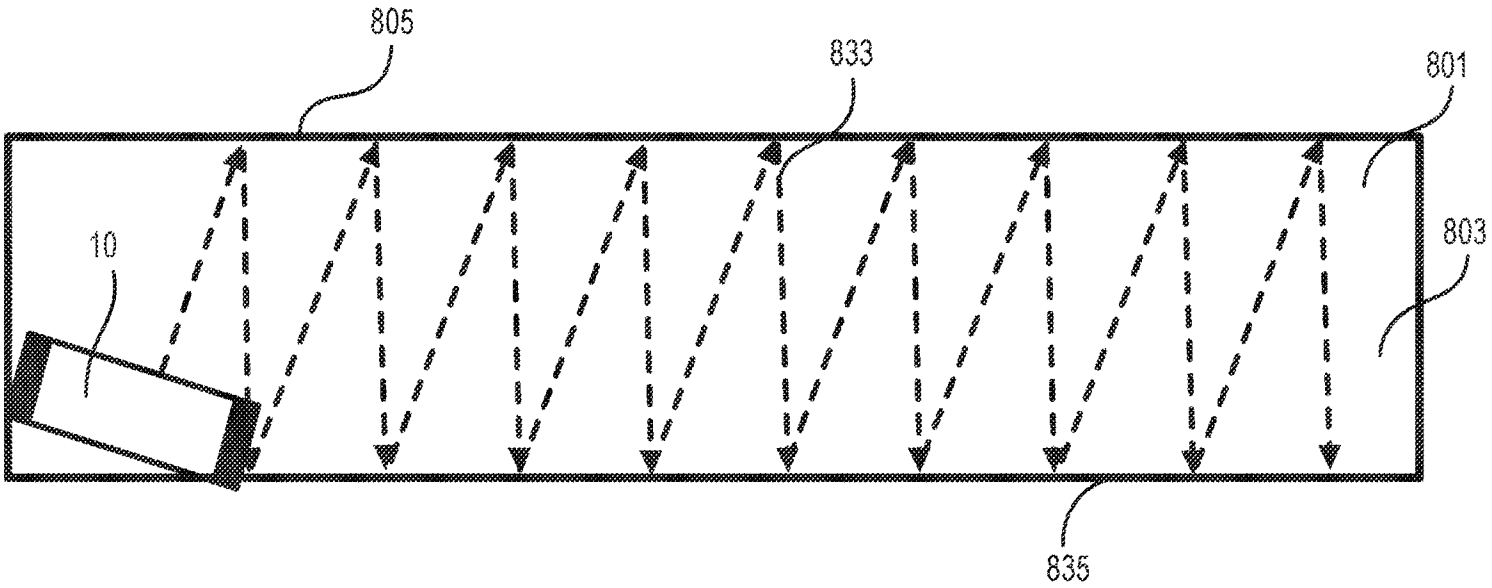
FIG. 8 illustrates another exemplary cleaning pattern performed by an APC according to embodiments.
Figure 9:
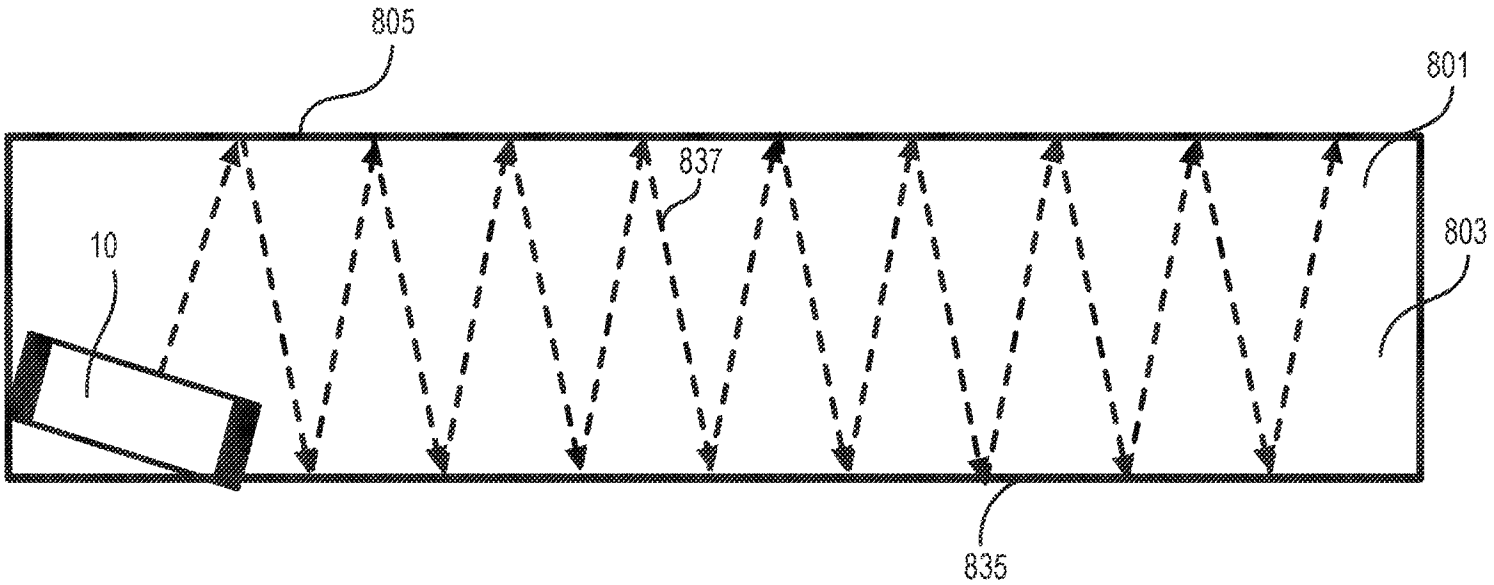
FIG. 9 illustrates another exemplary cleaning pattern performed by an APC according to embodiments.

FIGS. 8 and 9 illustrate cleaning patterns of the APC 10 along a run 803 of a step 801. FIGS. 8 and 9 are each plan views of the step 801 such that the run 803 is visible as well as an edge 805 of the step 801. A rise or other vertical wall 835 may be provided opposite from the edge 805. FIG. 8 illustrates a first cleaning pattern (represented by dashed lines 833) and FIG. 9 illustrates a second cleaning pattern (represented by dashed lines 837). In both embodiments, as the APC 10 approaches the edge 805 of the run 803 and/or the rise or vertical wall 835, the APC 10 may adjust its direction each time it approaches the edge 805 and/or the rise 835. The difference between the first cleaning pattern 833 and the second cleaning pattern 837 is that, in the first cleaning pattern 833, the APC 10 changes its direction to a lesser extent compared to the second cleaning pattern 837. Various other cleaning patterns may be performed to clean the run 803 of the step 801 as desired. In this way, the APC 10 can traverse along the width of the run 803 of the step 801.

Figure 10:
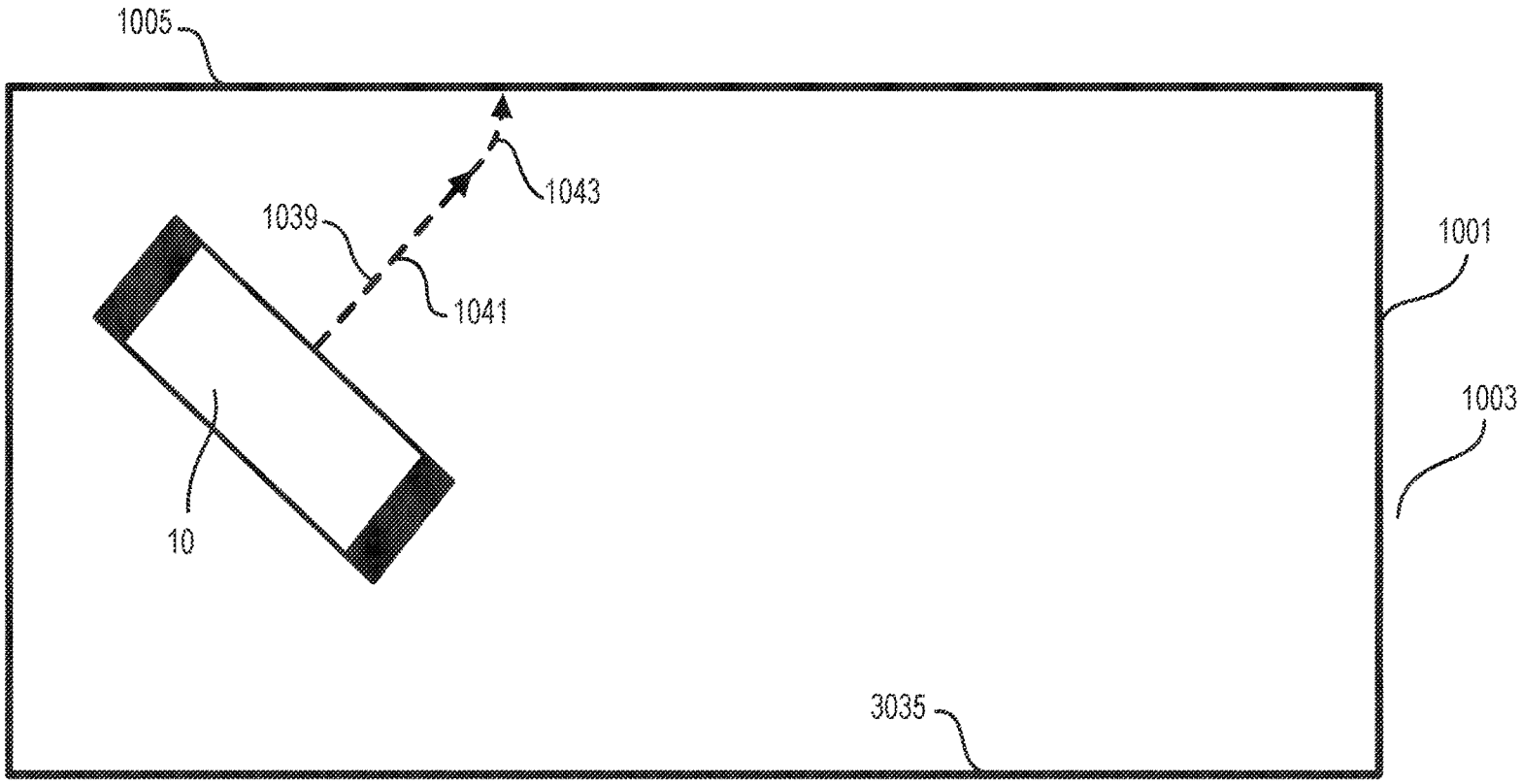
FIG. 10 illustrates another exemplary cleaning pattern performed by an APC according to embodiments.

While the cleaning patterns illustrated thus far have been illustrated with linear paths, the cleaning patterns need not be limited to linear travel paths by the APC 10. As an example, FIG. 10 illustrates yet another cleaning patterns of the APC 10 along a run 1003 of a step 1001. FIG. 10 is a plan view of the step 1001 such that the run 1003 is visible as well as an edge 1005 of the step 1001. A rise or other vertical wall 1035 may be provided opposite from the edge 1005. The cleaning pattern in FIG. 10 is represented by dashed lines 1039. In certain embodiments, as the APC 10 approaches the edge 1005 (and/or the rise 1035), the APC 10 may change or otherwise alter or adjust its direction of travel. In FIG. 10, the change in direction is represented by the two portions of the cleaning pattern 1039—the APC 10 may travel along a linear path 1041 until the APC 10 approaches the edge 1005, whereby the APC 10 travels along a non-linear path 1043. The two paths 1041, 1043 of the pattern 1039 are for illustrative purposes and should not be considered limiting as in other embodiments, the APC 10 may travel along other linear paths and/or non-linear paths as desired. Similarly, as the APC 10 travels away from the edge 1005, it may alter its direction of travel. In certain embodiments, cleaning the step may include altering movement of the APC 10 by altering the direction of the APC 10 until the APC 10 has traversed a width of the step.

Floating Bypass

Figure 11:
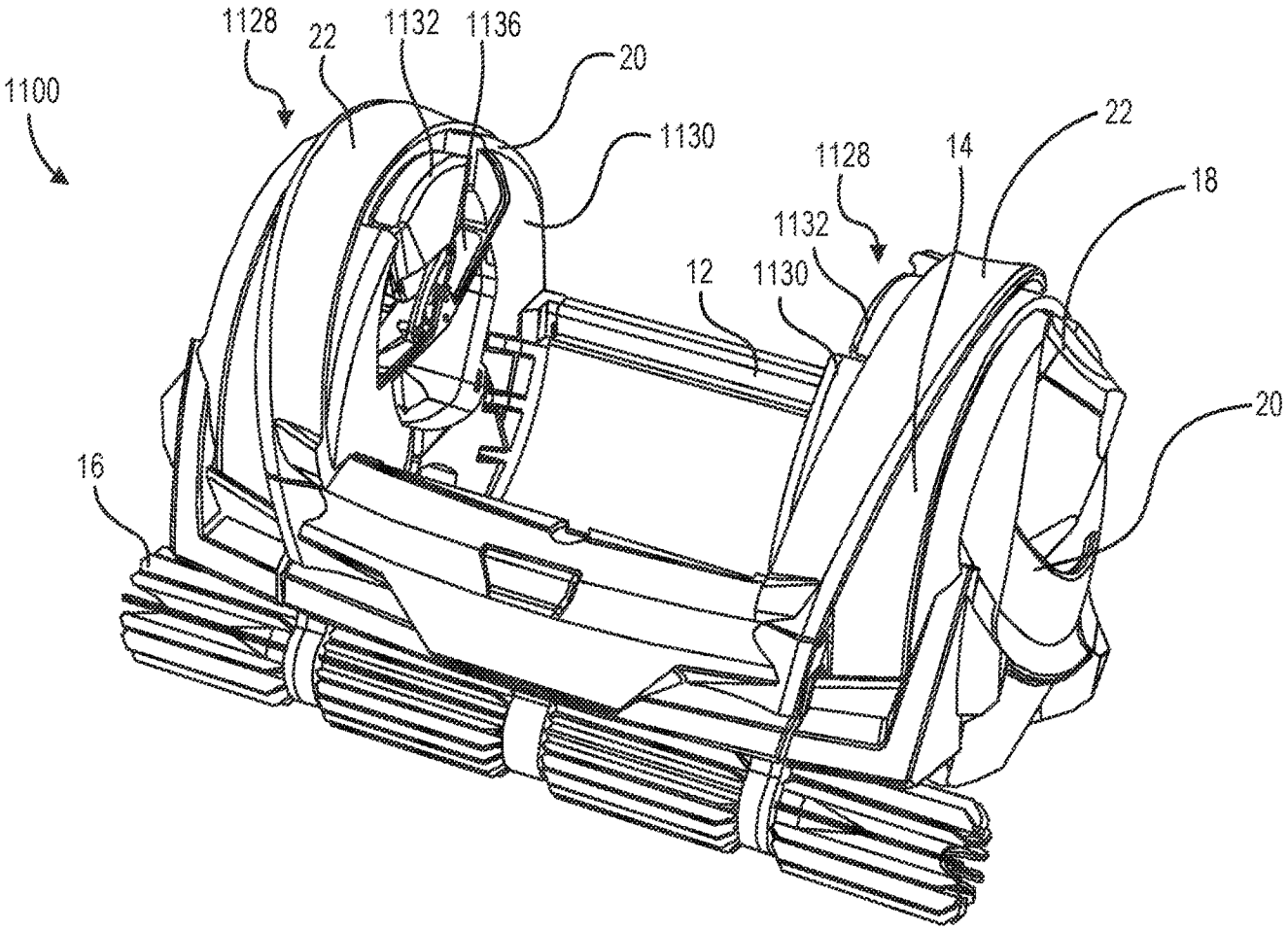
FIG. 11 illustrates an APC with a bypass valve assembly according to embodiments.
Figure 12:
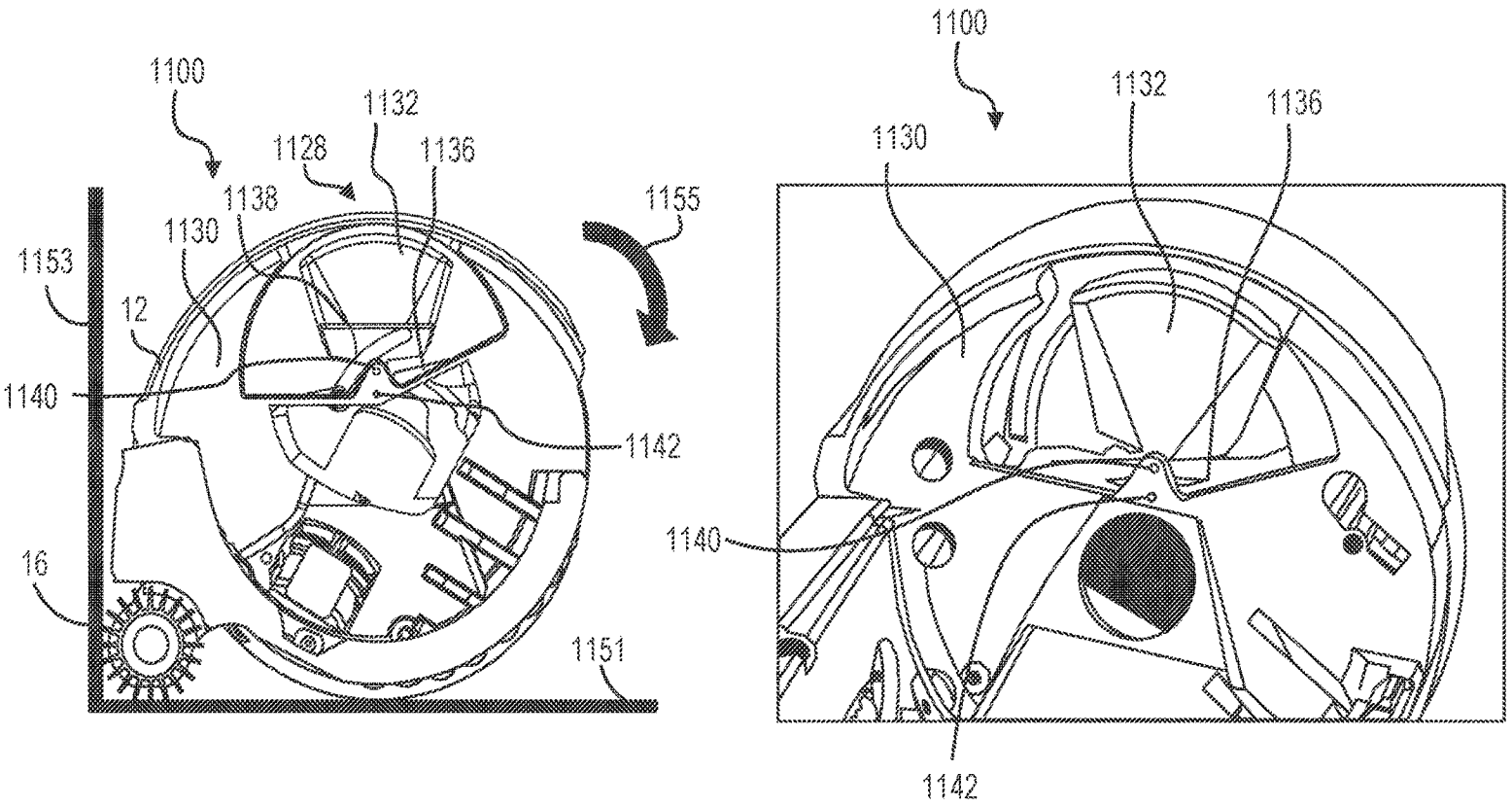
FIGS. 12A-B illustrate the APC of FIG. 11 in a horizontal orientation and the bypass valve assembly in a closed position.

FIGS. 11-14B illustrate another example of an APC 1100 according to embodiments of the disclosure. The APC 1100 is substantially similar to the APC 10 except that the APC 1100 includes a bypass valve assembly 1128. In FIG. 11, a filter assembly of the APC 1100 is omitted for clarity of the figure and such that the bypass valve assembly 1128 is visible. FIGS. 12A-14B show the bypass valve assembly 1128 in three positions—closed (FIGS. 12A-B), half-open (FIGS. 13A-B), and open (FIGS. 14A-B)—as the APC 1100 transcends from a floor 1151 of a pool to a wall 1153 of a pool (with change of orientation represented by arrow 1155 in FIG. 12A).

When included, the bypass valve assembly 1128 may allow for a full flow of water to the pump motors of the APC 1100 when the APC 1100 is climbing the wall 1153. Without the bypass valve assembly 1128, a clogged filter of the APC 1100 may prevent and/or compromise the ability of the APC 1100 to ascend and/or stay on the wall 1153. For example, a thrust force caused by the pump motor directing water out the outlet 18 allows the APC 1100 to climb and clean the wall and/or the waterline of the pool, and a clogged filter diminishes this thrust force. The diminished ability of the APC 1100 to stay on the wall in turn detracts from the ability of the APC 1100 to perform an effective cleaning pattern and the user's perception of the performance of the APC 1100. In various embodiments, the bypass valve assembly 1128 described herein allows water to bypass the filter when the orientation of the APC 1100 is generally in a vertical orientation (see, e.g., FIG. 14).

As best illustrated in FIG. 11, in certain embodiments, a bypass valve assembly 1128 is provided on and/or proximate the hub 20 of the APC 1100, and the APC 1100 may include two bypass valve assemblies 1128 (e.g., one on each side of the APC 1100).

Each bypass valve assembly 1128 includes a support 1130, a float 1132, a bypass opening 1134 (see FIGS. 13B and 14B), a valve door 1136, and an actuator arm 1138. The actuator arm 1138 is omitted from FIGS. 12B, 13B, and 14B for clarity of the figures. The float 1132 is pivotably attached to the support 1130 at a first pivot point 1140, and the door 1136 is pivotably attached to the support 1130 at a second pivot point 1142.

The actuator arm 1138 links the float 1132 and the valve door 1136 such that movement of the float 1132 causes movement of the door 1136. In various embodiments, connecting the float 1132 to the valve door 1136 via the actuator arm 1138 (rather than directly connecting the float 1132 to the valve door 1136) may provide a lever advantage to the beginning of the opening stroke or movement of the valve door 1136. As an example, although the valve door 1136 is balanced (i.e., the second pivot point 1142 is in the middle of the valve door 1136), there is a considerable force keeping it shut when the pump motor is trying to draw from a clogged/dirty filter. The lever advantage achieved via the actuator arm 1138 helps to overcome this closing-force and ensures that the valve door 1136 will open in all conditions. In certain embodiments, the arrangement of the pivot points of the float 1132, the valve door 1136, and the actuator arm 1138 is such that the lever advantage is at its greatest when "cracking the valve open" (i.e., initially opening the valve door 1136 from a closed position) and diminishes as the valve door 1136 progresses to its fully open state.

In FIGS. 12A-B, the valve door 1136 is closed and obstructing the bypass opening 1134. In this orientation, water is flowing from the pool into the APC 1100 via the inlet of the APC 1100, into and through the filter of the APC 1100 (past the closed bypass opening 1134), to the pump of the APC 1100, and out the outlets 18 as thrust.

Figure 13B:
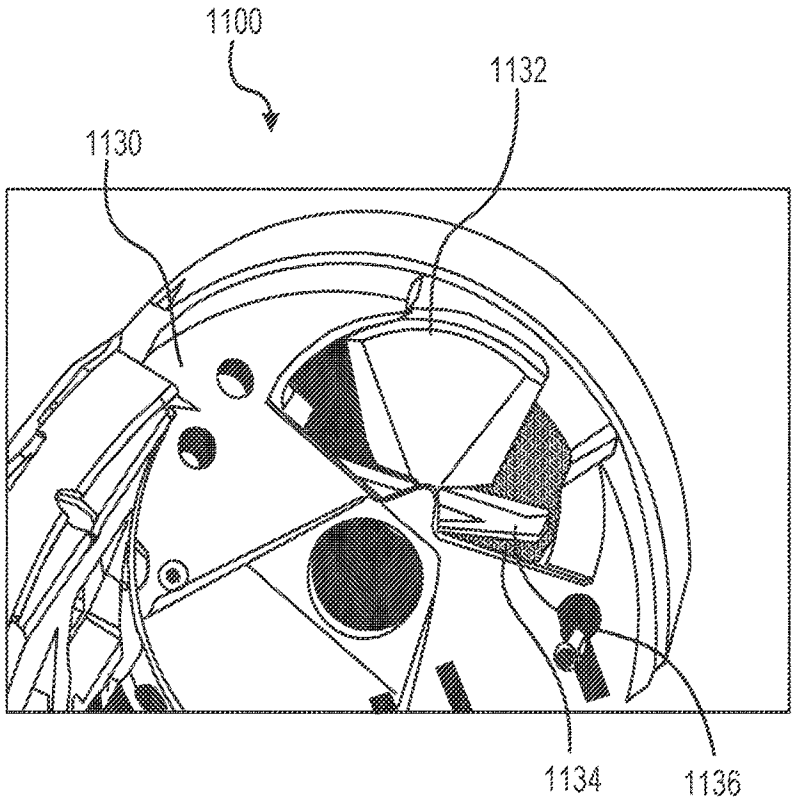
FIGS. 13A-B illustrate the APC of FIG. 11 in an intermediate orientation and the bypass valve assembly in a half-open position.
Figure 13A:
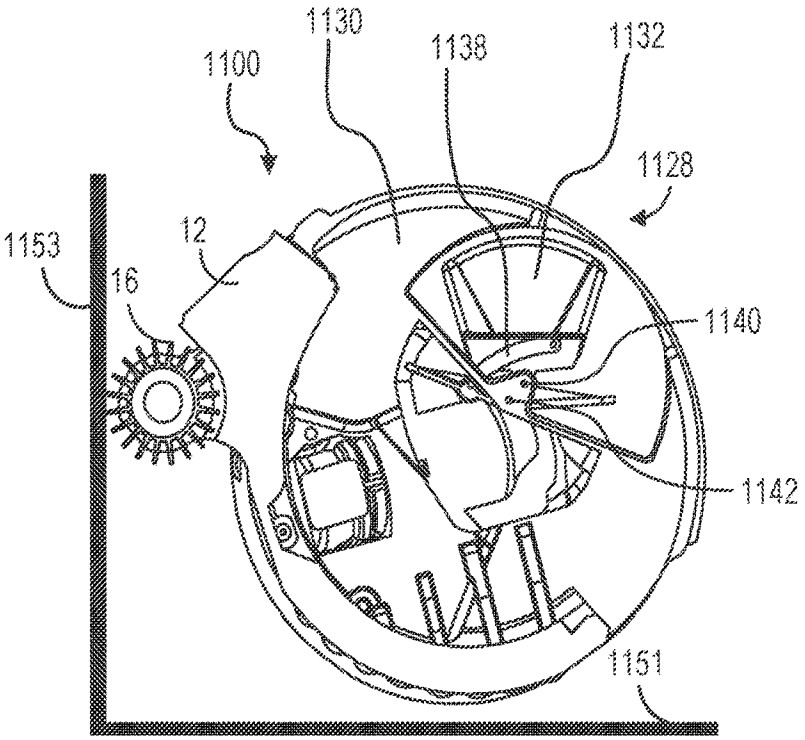
Figure 14B:
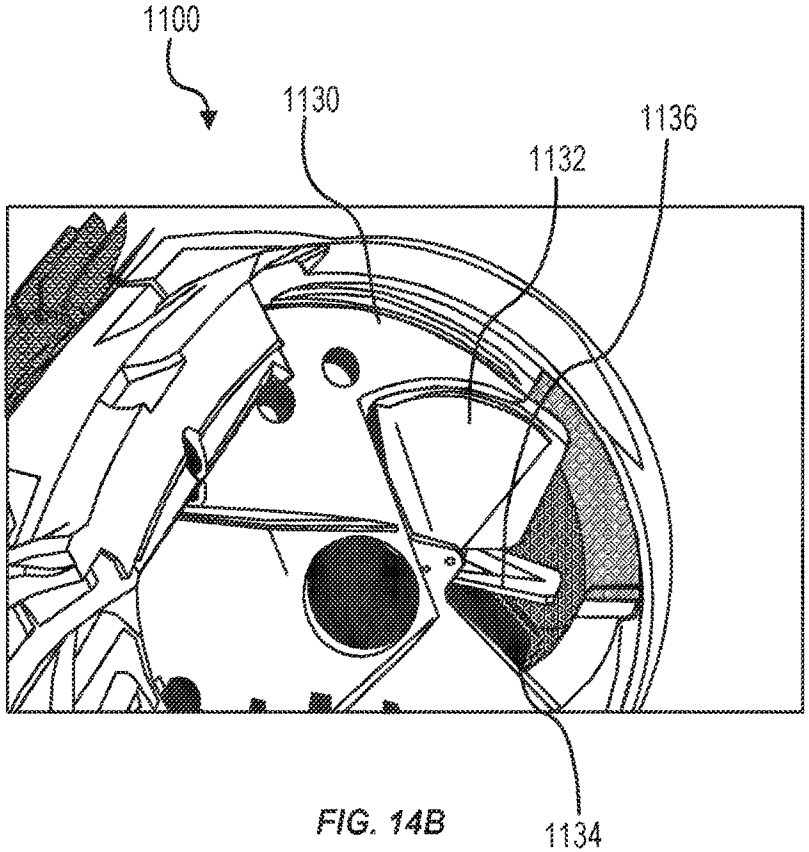
FIGS. 14A-B illustrate the APC of FIG. 11 in a vertical orientation and the bypass valve assembly in an open position.
Figure 14A:
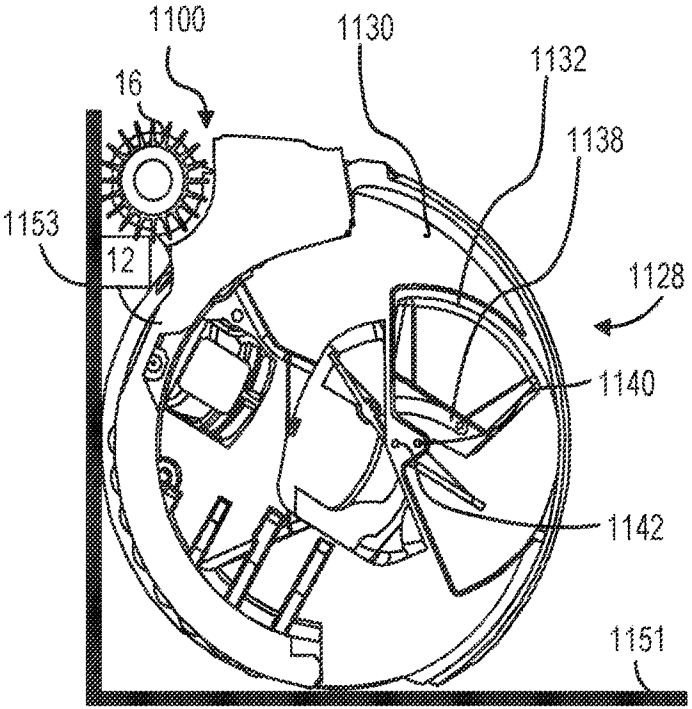

Referring to FIGS. 13A-B, as the angle of the APC 1100 changes relative to the floor 1151 (e.g., by transcending from the floor 1151 to the wall 1153), the float 1132, which is buoyant, wants to stay vertical above the first pivot point 1140. Such movement of the float 1132 in turn exerts a force via the actuator arm 1138 on the valve door 1136 and the valve door 1136 starts to open and/or no longer obstruct the bypass opening 1134. FIGS. 14A-B illustrate the valve door 1136 in a fully open position when the APC 1100 is oriented vertically on the wall 1153. When the valve door 1136 is in the fully open position, water bypasses the filter so a full flow of water is directed to the pump motors of the APC 1100. In particular, when the valve door 1136 is open and therefore not obstructing the bypass opening 1134, water is flowing from the pool into the APC 1100 via one or more inlets, into and through the bypass opening 1134 (thereby bypassing the filter), and out the APC 1100 via one or more outlets.

Exemplary concepts or combinations of features of the invention may include, but are not limited to, the following statements:

A. An APC comprising a body, motive elements configured to move the body along a surface of a swimming pool, and a sensor for tracking a distance travelled by the APC.

B. The APC of any preceding or subsequent statement or combination of statements, wherein the sensor comprises an optical flow sensor.

C. The APC of any preceding or subsequent statement or combination of statements, wherein the sensor is on, in, or carried by the body of the APC and directed at the surface over which the APC is travelling.

D. The APC of any preceding or subsequent statement or combination of statements, wherein the sensor further comprises a light source directed at a surface over which the APC is travelling, and wherein an intensity of the light source is adjustable.

E. The APC of any preceding or subsequent statement or combination of statements, wherein the body is generally cylindrical and comprises an inlet for receiving water of a swimming pool, wherein the motive elements are at opposing ends of the body, and wherein the APC further comprises outlets for exhausting the water from the body, wherein the motive elements are between the outlets and the body.

F. The APC of any preceding or subsequent statement or combination of statements, wherein the sensor is configured to track a direction of movement of the APC.

G. An APC comprising a body, motive elements configured to move the body along a surface of a swimming pool, a pressure sensor configured to detect a depth of the APC in the swimming pool, and a controller configured to maintain the depth of the APC based on the detected depth from the pressure sensor.

H. The APC of any preceding or subsequent statement or combination of statements, wherein the body comprises an inlet for receiving water of a swimming pool, wherein the motive elements are at opposing ends of the body, and wherein the APC further comprises outlets for exhausting the water from the body, wherein the motive elements are between the outlets and the body.

I. The APC of any preceding or subsequent statement or combination of statements, wherein the body is generally cylindrical.

J. An APC comprising a body, motive elements configured to move the body along a surface of a swimming pool and in a first direction, and a sensor oriented in a second direction that is different from the first direction, the sensor configured to detect a distance or proximity in the second direction.

K. The APC of any preceding or subsequent statement or combination of statements, further comprising a sensor oriented in the first direction and configured to detect a distance or proximity in the first direction.

L. The APC of any preceding or subsequent statement or combination of statements wherein the body is generally cylindrical and comprises an inlet for receiving water of a swimming pool, wherein the motive elements are at opposing ends of the body, and wherein the APC further comprises outlets for exhausting the water from the body, wherein the motive elements are between the outlets and the body.

M. The APC of any preceding or subsequent statement or combination of statements, wherein the second direction is a non-vertical direction.

N. The APC of any preceding or subsequent statement or combination of statements, wherein the sensor is an optical sensor comprising a time-of-flight sensor or an optical light intensity sensor.

O. The APC of any preceding or subsequent statement or combination of statements, wherein the sensor is configured to track a direction of movement of the APC.

P. A method of cleaning walls of a swimming pool comprising:
   i. causing operation of an APC comprising a body, motive elements configured to move the body along the wall, and a pressure sensor configured to detect a depth of the APC in the swimming pool; and
   ii. controlling the APC to clean in a horizontal direction along the walls of the swimming pool, wherein controlling the APC comprises controlling the depth of the APC based on the depth detected by the pressure sensor.

Q. The method of any preceding or subsequent statement or combination of statements, wherein controlling the APC comprises maintaining the depth across the walls based on the depth detected by the pressure sensor.

R. A method of cleaning a surface of a swimming pool comprising:
   i. causing operation of an APC comprising a body, motive elements configured to move the body along the surface, and a sensor on, in, or carried by the body; and
   ii. tracking a distance travelled by the APC using the sensor.

S. The method of any preceding or subsequent statement or combination of statements, wherein the sensor is directed at the surface over which the APC is travelling.

T. The method of any preceding or subsequent statement or combination of statements, wherein the sensor is an optical sensor.

U. The method of any preceding or subsequent statement or combination of statements, wherein causing operation comprises maintaining the sensor a predetermined distance from the surface.

V. The method of any preceding or subsequent statement or combination of statements, wherein tracking the distance comprises detecting a distance or proximity in a direction other than a direction of movement of the APC.

W. A method of cleaning a swimming pool, the method comprising:
   i. climbing, by an APC, a plurality of steps in a going up direction;
   ii. determining, by the APC, when the APC is at a highest step of the plurality of steps; and
   iii. cleaning, by the APC, the plurality of steps in a going down direction.

X. The method of any preceding or subsequent statement or combination of statements, wherein cleaning the plurality of steps in the going down direction comprises:
   i. cleaning a run of the highest step of the plurality of steps;
   ii. climbing over and down, by the APC, an edge of the step forming the transition between the run of the highest step and a rise of a next highest step of the plurality of steps; and
   iii. cleaning, by the APC, a run of the next highest step after cleaning the rise of the next highest step and after climbing over and down the edge.

Y. The method of cleaning of any preceding or subsequent statement or combination of statements, wherein cleaning the run of the step comprises moving the automatic swimming pool cleaner toward the edge of the step.

Z. A method of cleaning a swimming pool, the method comprising:

i. cleaning, by an automatic swimming pool cleaner (APC), a run of a step by advancing the APC towards an edge of the run of the step; and ii. altering movement and/or a direction of the APC upon a detection, by a sensor of the APC, of the edge of the run of the step.

AA. The method of any preceding or subsequent statement or combination of statements, wherein altering the APC comprises advancing the APC away from the edge along a non-edge portion of the run of the step.

BB. The method of any preceding or subsequent statement or combination of statements, wherein altering the APC comprises changing an orientation of the APC relative to the edge of the run of the step by independently controlling thrust from pumps of the APC.

CC. The method of any preceding or subsequent statement or combination of statements, further comprising stopping a cleaning operation upon the detection of the proximity of the at least one motive element of the APC to the edge of the run of the step.

DD. The method of any preceding or subsequent statement or combination of statements, wherein altering movement of the APC comprises causing the APC to travel away from the edge of the run of the step.

EE. The method of any preceding or subsequent statement or combination of statements, wherein altering movement of the APC comprises causing the APC to remain on the run of the step and traverse along a width of the run of the step.

FF. The method of any preceding or subsequent statement or combination of statements, wherein altering movement of the APC comprises altering the direction of the APC until the APC has traversed a width of the step.

GG. A method of cleaning a swimming pool, the method comprising:

i. cleaning, by an APC, a run of a step by advancing the APC towards an edge of the run of the step; and ii. altering a direction of the APC based on an approach of the APC to the edge of the run of the step or an approach of the APC to a rise or vertical wall.

HH. The method of any preceding or subsequent statement or combination of statements, wherein altering the direction of the APC comprises causing the APC to travel away from the edge of the run of the step or away from the rise.

II. The method of any preceding or subsequent statement or combination of statements, wherein altering the direction of the APC comprises causing the APC to remain on the run of the step while traveling away from the edge or the rise.

JJ. The method of any preceding or subsequent statement or combination of statements, wherein altering movement of the APC comprises altering the direction of the APC until the APC has traversed a width of the step.

KK. An APC comprising a bypass valve assembly, the bypass valve assembly comprising a valve door, a float, and an actuator arm linking the valve door to the float, wherein the bypass valve assembly is configured to selectively open or close a bypass opening based on an orientation of the APC.

LL. The APC of any preceding or subsequent statement or combination of statements, wherein the bypass valve assembly further comprises a support, wherein the float is pivotably connected to the support at a first pivot location, and wherein the valve door is pivotably connected to the support at a second pivot location.

MM. The APC of any preceding or subsequent statement or combination of statements, wherein the bypass valve assembly is configured to open the bypass opening based on the APC being in a vertical orientation.

NN. The APC of any preceding or subsequent statement or combination of statements, wherein, when the bypass opening is closed, a flow of water through the APC is through a filter of the APC, and wherein, when the bypass opening is open, a flow of water through the APC bypasses the filter of the APC.

These examples of features of an automatic pool cleaner are not intended to be mutually exclusive, exhaustive, or restrictive in any way, and the invention is not limited to these example embodiments but rather encompasses all possible modifications and variations within the scope of any claims ultimately drafted and issued in connection with the invention (and their equivalents). For avoidance of doubt, any combination of features not physically impossible or expressly identified as non-combinable herein may be within the scope of the invention.

The entire contents of the Deloche patent are incorporated herein by this reference. Further, although applicant has described cleaning devices for use with water containing vessels, persons skilled in the relevant field will recognize that the present invention may be employed in other manners. Finally, references to "pools" and "swimming pools" herein may also refer to spas or other water containing vessels used for recreation or therapy and for which cleaning is needed or desired.

What is claimed is:

1. An automatic swimming pool cleaner (APC) comprising:

a body housing a pump motor within the body;

motive elements configured to contact a surface of a swimming pool and move the body along the surface of the swimming pool; and a sensor on, in or carried by the body, wherein the sensor comprises a sensing region projected below a bottom surface of the body of the APC.

2. The APC of claim 1, wherein the sensor comprises an optical flow sensor.

3. The APC of claim 1, wherein the sensor further comprises a light source directed at the surface over which the APC is travelling, and wherein an intensity of the light source is adjustable.

4. The APC of claim 1, wherein the body is generally cylindrical and comprises an inlet for receiving water, wherein the motive elements are at opposing ends of the body, and wherein the APC further comprises outlets for exhausting the water from the body, wherein the motive elements are between the outlets and the body.

5. The APC of claim 1, wherein the sensor is configured to track a direction of movement of the APC.

6. An automatic swimming pool cleaner (APC) comprising:

a body housing a pump motor within the body;

motive elements configured to move the body along a surface of a swimming pool, wherein the motive elements are on opposing ends of the body, and wherein a width of the body is greater than a length of the body;

a first sensor configured to detect a depth of the APC in the swimming pool;

a second sensor on, in or carried by the body, wherein the sensor comprises a sensing region projected below a bottom surface of the body of the APC; and a controller configured to maintain the depth of the APC based on the detected depth from the first sensor and the second sensor.

7. The APC of claim 6, wherein the body comprises an inlet for receiving water of a swimming pool, wherein the motive elements are at opposing ends of the body, and wherein the APC further comprises outlets for exhausting the water from the body, wherein the motive elements are between the outlets and the body.

8. The APC of claim 6, further comprising a sensor configured to detect a distance or proximity.

9. The APC of claim 6, further comprising an optical sensor comprising a time-of-flight sensor or an optical light intensity sensor.

10. The APC of claim 9, wherein the optical sensor is configured to track a direction of movement of the APC.

11. A method of cleaning walls of a swimming pool comprising:

causing operation of an automatic swimming pool cleaner (APC) comprising a body housing a pump motor within the body, motive elements configured to move the body along the wall, a first sensor configured to detect a depth of the APC in the swimming pool, and a second sensor on, in or carried by the body, wherein the sensor comprises a sensing region projected below a bottom surface of the body of the APC, wherein the motive elements are on opposing ends of the body, and wherein a width of the body is greater than a length of the body; and controlling the APC to clean in a horizontal direction along the walls of the swimming pool, wherein controlling the APC comprises controlling the depth of the APC based on data from the second sensor and the depth detected by the first sensor.

12. The method of claim 11, wherein the first sensor is a pressure sensor, and wherein controlling the APC comprises maintaining the depth across the walls based on the depth detected by the pressure sensor.

13. The method of claim 11, further comprising tracking a direction of movement of the APC.

14. A method of cleaning a surface of a swimming pool comprising:

causing operation of an automatic swimming pool cleaner (APC) comprising a body, a pump motor within the body, motive elements configured to move the body along the surface, and a sensor on, in, or carried by the body, wherein the sensor comprises a sensing region projected below a bottom surface of the body of the APC; and tracking a distance travelled by the APC using the sensor.

15. The method of claim 14, wherein the sensor is directed at the surface over which the APC is travelling.

16. The method of claim 14, wherein the sensor is an optical sensor.

17. The method of claim 14, wherein causing operation comprises maintaining the sensor a predetermined distance from the surface.

18. The method of claim 14, wherein tracking the distance comprises detecting a distance or proximity in a direction other than a direction of movement of the APC.

19. The APC of claim 1, wherein the sensor is oriented vertically downwards relative to the bottom surface of the APC.

20. The APC of claim 1, wherein the sensor is a predetermined height above a portion of the surface of the swimming pool that the motive elements are in contact with.

* * * * *